US007915568B2

(12) United States Patent
Wang

(10) Patent No.: US 7,915,568 B2
(45) Date of Patent: Mar. 29, 2011

(54) MULTIFUNCTION MICROWAVE OVEN WITH SUPERHEATED STEAM AND THE CONTROL METHOD THEREOF

(76) Inventor: Dong-Iei Wang, Zhuhai (CN)

( * ) Notice: Subject to any disclaimer, the term of this patent is extended or adjusted under 35 U.S.C. 154(b) by 1113 days.

(21) Appl. No.: 11/622,049

(22) Filed: Jan. 11, 2007

(65) Prior Publication Data

US 2007/0158338 A1 Jul. 12, 2007

(30) Foreign Application Priority Data

Jan. 11, 2006 (CN) ..... 2006 2 0053579 U

(51) Int. Cl.
*H05B 6/80* (2006.01)

(52) U.S. Cl. ..... 219/680; 219/682

(58) Field of Classification Search ..... 219/680, 219/682, 628, 729, 732, 676, 630, 679, 733, 219/735; 426/242, 637, 557, 451, 516, 113, 107

See application file for complete search history.

(56) References Cited

U.S. PATENT DOCUMENTS

2008/0229936 A1* 9/2008 Kaneko et al. ..... 99/357

FOREIGN PATENT DOCUMENTS

JP 2005241188 A * 9/2005

* cited by examiner

*Primary Examiner* — Quang T Van
(74) *Attorney, Agent, or Firm* — Carstens & Cahoon LLP

(57) ABSTRACT

The present invention disclosed a multifunction microwave oven with superheated steam and the control method thereof, so as to heat the food uniformly and to provide versatile heating modes including at least superheated steam mode, ordinary steam mode and convective hot flow mode.

12 Claims, 4 Drawing Sheets

MULTIFUNCTION MICROWAVE OVEN WITH SUPERHEATED STEAM AND THE CONTROL METHOD THEREOF

CROSS-REFERENCE TO RELATED APPLICATION

This application claims priority from CN Patent Application No. 200620053579.9 filed on Jan. 11, 2006, entitled "Multifunction Microwave Oven with Superheated Steam".

TECHNICAL FIELD

The present invention relates to an electric kitchen appliance, particularly to a multifunction microwave oven with superheated steam and the control method thereof.

BACKGROUND OF THE INVENTION

The conventional microwave oven existing in the market does not have a steam heating function. Although it has a high cooking speed and high cooking efficiency, but the cooked food is often lack of water, not fresh nor tender, therefore the conventional microwave oven is only suitable for limited types of food. On the other hand, the steam cookers existing in the market include steamers, electric saucepans, pressure cookers, even microwave steamers. However, all of these commercial available steam cookers can not generate superheated steam, and have defects such as low heating efficiency, low steam temperature, small amount of steam, large steam loss, low cooking speed, inconvenient operation, unsafe for use and unsatisfactory cooking effect. In a Chinese patent application publication CN1829882A, a steam cooker which can generate superheated steam is disclosed, wherein a sub cavity incorporating a steam heating heater is formed at the center of the ceiling part of a heating chamber. Steam in the heating chamber is sucked into an air blow device through a suction port and force-fed into the sub cavity through an external circulating passage. Gas passed through the external circulation passage sucks steam from a steam generator midway in the external circulation passage and enters from the external circulation passage into the sub cavity. The steam heated by the steam heating heater until it is brought into an superheated state is jetted downward from a plurality of upper gas jetting holes formed in the bottom panel of the sub cavity by such a force that makes the steam reach the bottom of the heating chamber so that the steam can be collided with a heated matter. The steam is raised on the outside of downward air flow and the convection of steam occurs in the heating chamber. However, in this patent application, an axial fan is adopted, and the circulation passage is very complicated, therefore a large space is needed; meanwhile, since the gas jetting holes are formed on the top of the heating chamber, the steam with higher temperature and pressure from the sub cavity blows downwards directly to the food from the top of the heating chamber, which causes the temperature of the top part of the food to increase rapidly, while the lateral part and bottom part of the food does not contact directly with the high temperature gas and the temperature thereof increases slowly. Therefore, during the whole heating process, the temperature within the heating chamber is not uniform, and the food can not be heated uniformly, causing some part of the food to be overheated but some part to be underheated, which affects the cooking quality.

SUMMARY OF THE INVENTION

The present invention aims to solve the above-mentioned shortcomings of the prior art, and to provide a multifunction microwave oven with superheated steam and the control method thereof, so as to heat the food uniformly and to provide versatile heating modes.

The above-mentioned object of the present invention is realized by the technical solution as described below:

A multifunction microwave oven with superheated steam, comprising a casing, a cooking chamber for accommodating food to be cooked, a microwave generating assembly for generating microwave for cooking food, a steam generating assembly, a steam heating assembly and a control circuit.

Wherein the steam generating assembly for generating ordinary steam of approximately 100° C. is located at the bottom or beside of the casing; said steam generating assembly includes a water tank, a water pump, water pipes, a boiler and an ordinary steam pipe, and wherein the water tank is located at the bottom or beside of the cooking chamber, and the boiler incorporates a heating means and a water level sensing means.

Wherein the steam heating assembly for generating superheated steam up to 400° C. is located at the top or beside of the cooking chamber; said steam heating assembly includes a convection heating cavity incorporating a centrifugal impeller and its driving means, and a heating means.

Wherein the ordinary steam pipe is connected with the convection heating cavity, and the ordinary steam from the boiler enters the convection heating cavity through this ordinary steam pipe; upper gas outlets and upper gas suction ports are disposed on the convection heating cavity, so that the superheated steam passes through the upper gas outlets of the convection heating cavity and blows outwardly and downwardly into the cooking chamber, while the backflowing gas is sucked from the central area of the cooking chamber and enters the convection heating cavity through the upper gas suction ports.

Preferably, the heating means of the boiler includes a first boiler heating tube and a second boiler heating tube which can be controlled separately. And the heating means of the convection heating cavity includes a first upper heating tube and a second upper heating tube which can be controlled separately. So that these four heating tubes can be controlled to work in different modes to generate at least superheated steam between 100° C. to 400° C., ordinary steam of approximately 100° C. and convective hot flow.

BRIEF DESCRIPTION OF THE DRAWINGS

The present invention is further explained by a preferred embodiment in combination with the accompanying drawings.

Wherein the numerals for the parts are listed as below:

1: motor for the rotating disc
2: glass rotating disc;
3: cooking chamber
4: high voltage transformer;
5: magnetron;
6: water tank;
7: water pump;

8: water pipe;
9: boiler;
10: big boiler heating tube;
11: small boiler heating tube;
12: water lever sensing bar;
13: ordinary steam pipe;
14: convection heating chamber;
15: centrifugal impeller;
16: upper big heating tube;
17: upper small heating tube;
18: belt;
19: motor;
20: cooling impeller;
21: thermistor;
22: upper gas outlets;
23: upper gas suction ports;
24: lower gas outlets.

DETAIL DESCRIPTION OF THE PREFERRED EMBODIMENTS

Figure 1:
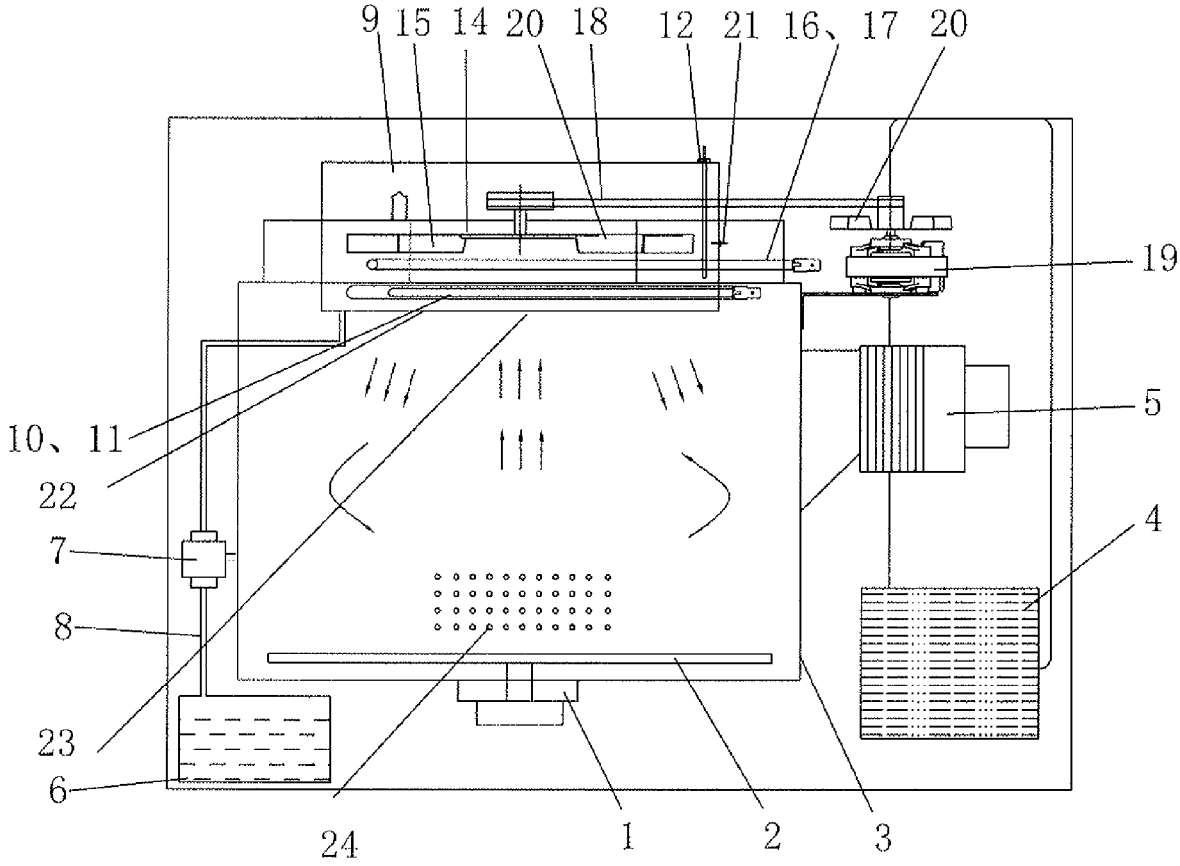
FIG. 1 is a schematic front view of the multifunction microwave oven with superheated steam according to one embodiment of the present invention.
Figure 2:
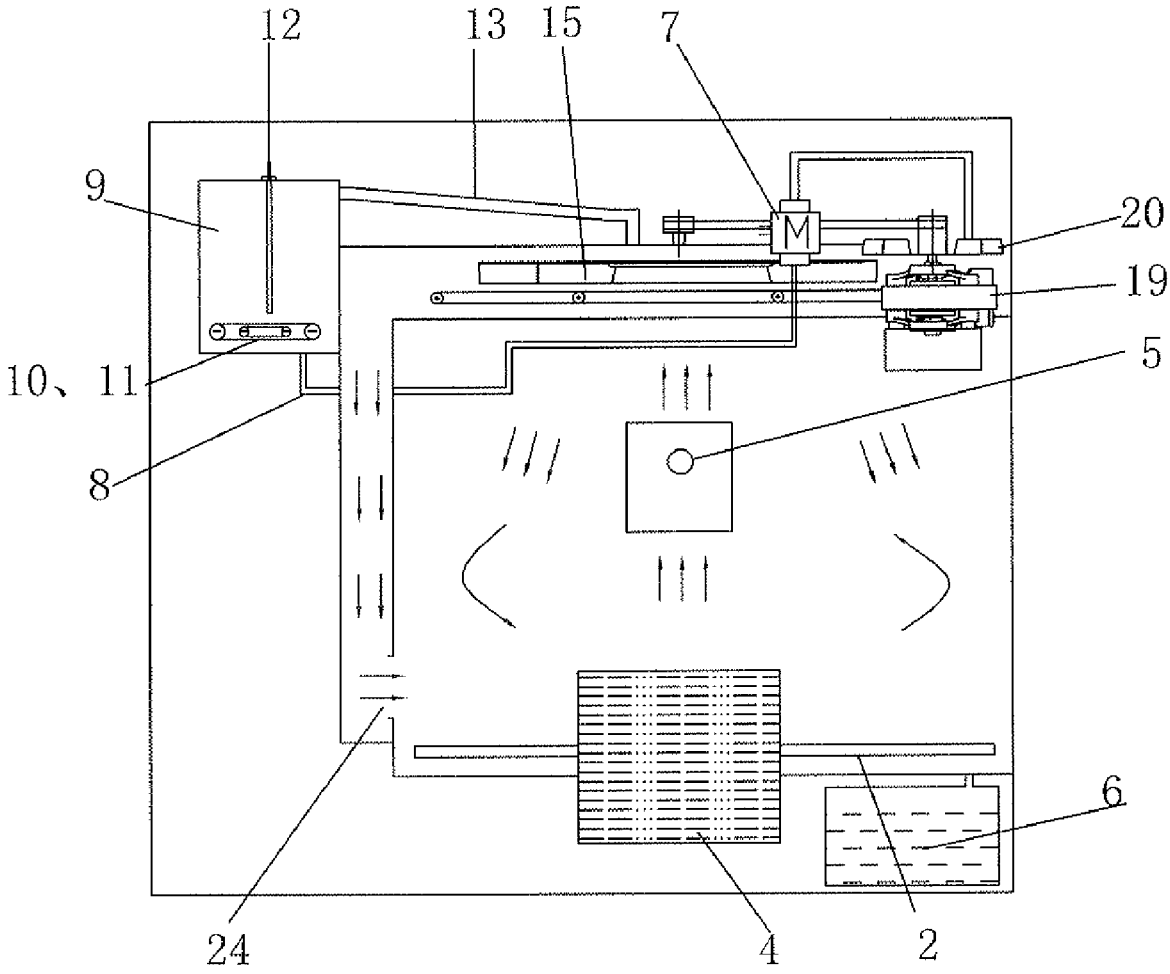
FIG. 2 is a schematic side view of the multifunction microwave oven with superheated steam as shown in FIG. 1.
Figure 3:
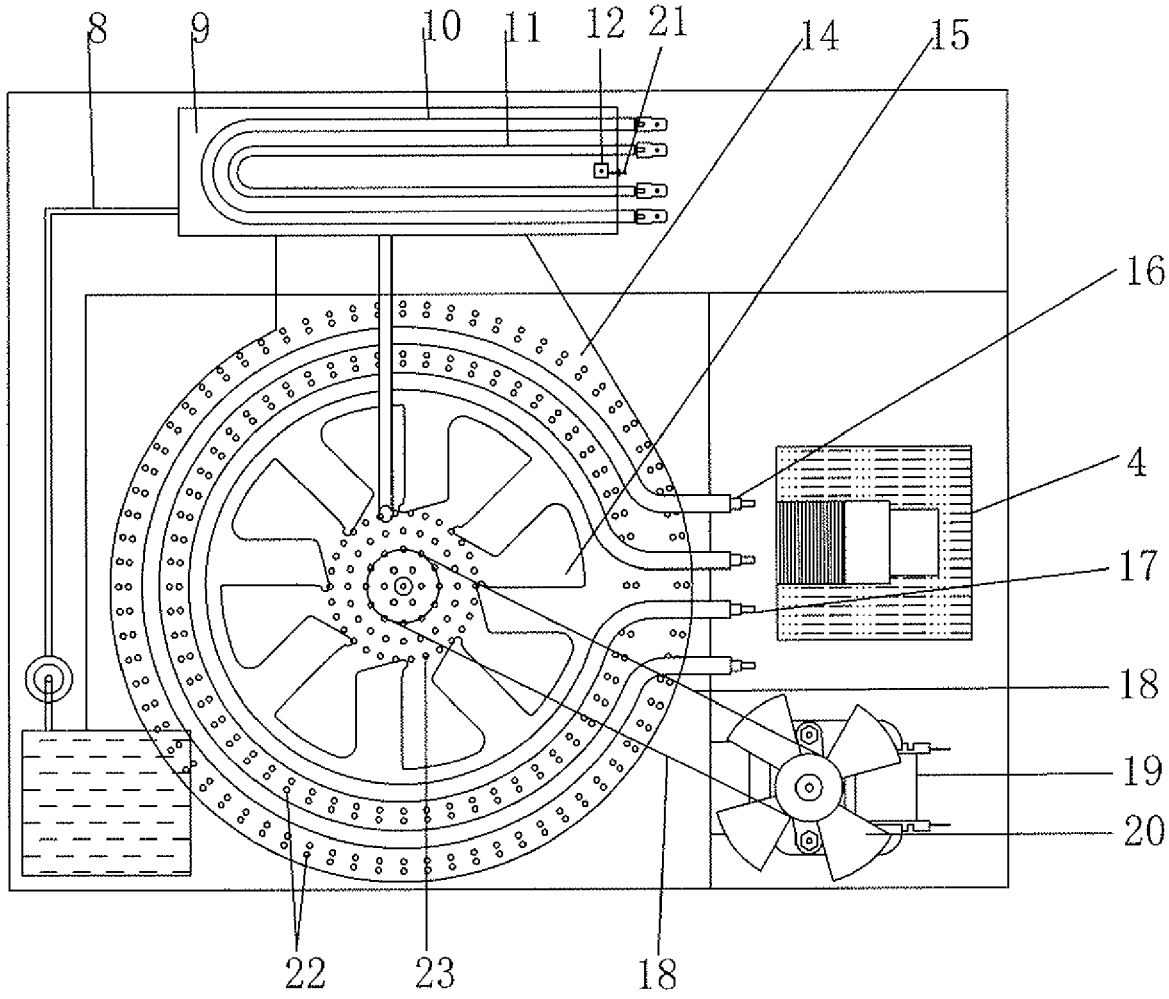
FIG. 3 is a schematic top view of the multifunction microwave oven with superheated steam as shown in FIG. 1.

The present invention will be illustrated in details referring to the embodiments as described below:

As shown in FIG. 1 to FIG. 3, according to one embodiment of the present invention, the multifunction microwave oven with superheated steam is comprised of a casing, a cooking chamber 3, a microwave generating assembly, a steam generating assembly, a steam heating assembly and a control circuit.

The cooking chamber 3 incorporates a glass rotating disc 2 driven by a motor 1, for accommodating food to be cooked.

The microwave generating assembly includes a high voltage transformer 4 and a magnetron 5, for generating microwave for cooking food.

The steam generating assembly for generating ordinary steam of approximately c is located at the bottom or beside of the casing, including a water tank 6, a pump 7, water pipes 8, a boiler 9 and an ordinary steam pipe 13. The water tank 6 is located at the bottom of the cooking chamber 3. The boiler 9 incorporates a big boiler heating tube 10, a small boiler heating tube 11 and a water lever sensing bar 12. The water lever sensing bar 12 is installed within the water tank 6, whose resistance value varies with the water level, so that the control unit of the control circuit will acquire the information of the water level and send instructions to the water pump 7.

The steam heating assembly for generating superheated steam up to 400° C. is located at the top or beside the cooking chamber. The steam heating assembly includes a convection heating cavity 14 incorporating a centrifugal impeller 15, a driving means for the centrifugal impeller 15, an upper big heating tube 16, and an upper small heating tube 17. The driving means for the centrifugal impeller 15 comprises a belt 18, a motor 19 and a impeller 20 for cooling the motor 19.

In addition to heating tubes, the heating means in the steam generating assembly or in the steam heating assembly may include other types of heating means such as electric-heated diaphragms, semiconductor heating means, etc.

The ordinary steam pipe 13 is connected with the convection heating cavity 14, and the ordinary steam from the boiler 9 enters the convection heating cavity 14 through this ordinary steam pipe 13.

Upper gas outlets 22 and upper gas suction ports 23 are disposed at the bottom panel of the convection heating cavity 14. The upper gas suction ports 23 include plurality of through holes distributed within an inner circular region at the bottom panel of the convection heating cavity 14, and the upper gas outlets 22 include plurality of through holes distributed within an outer circular ring at the bottom panel of the convection heating cavity 14.

The inner circular region, the outer circular ring and the impeller 15 are concentric. And the inner circular region and the outer circular ring are positioned to conform to the radial dimension of blades of the centrifugal impeller 15, i.e., the blades are substantially located within the separation between the inner circular region and the outer circular ring.

The convection heating cavity 14 has a side passage connected to the cooking chamber 3, and the interface between the convection heating cavity 14 and the cooking chamber 3 is a wall with plurality of through holes thereon, namely the lower gas outlets 24. The lower gas outlets 24 are distributed within a rectangular region at the bottom of the cooking chamber 3.

Some of the superheated steam passes through the upper gas outlets 22 of the convection heating cavity 14 and blows outwardly and downwardly into the cooking chamber, while some of the superheated steam passes through the lower gas outlets 24 and blows forwardly and horizontally to the lower region of the cooking chamber 3. The backflowing gas is sucked from the central area of the cooking chamber 3 and enters the convection heating cavity 14 through the upper gas suction ports 23.

The blades of the centrifugal impeller 15 rotate in a high speed by the driving means, which produce a gas flow in the cooking chamber 3. The gas within the convection heating cavity 14 rotates in a high speed around the periphery of the blades of the centrifugal impeller 15, and spreads away from the convection heating cavity 14 through the upper gas outlets 22. Meanwhile, under the centrifugal effect, the gas at the lower region of the cooking chamber 3 is sucked towards the convection heating cavity 14 through the upper gas suction ports 23. Thus, a convection and circulating passage for the steam and hot air is formed.

During the high speed rotation of the blades of the centrifugal impeller 15, some of the superheated steam passes through the lower gas outlets 24 and enters the cooking chamber 3, so as to heat the bottom of the food loaded on the glass rotating disc 2. The lower gas outlets 24 may be positioned at the left side, right side or back side of the cooking chamber 3. However, the lower gas outlets 24 are not necessarily needed for this invention.

Figure 4:
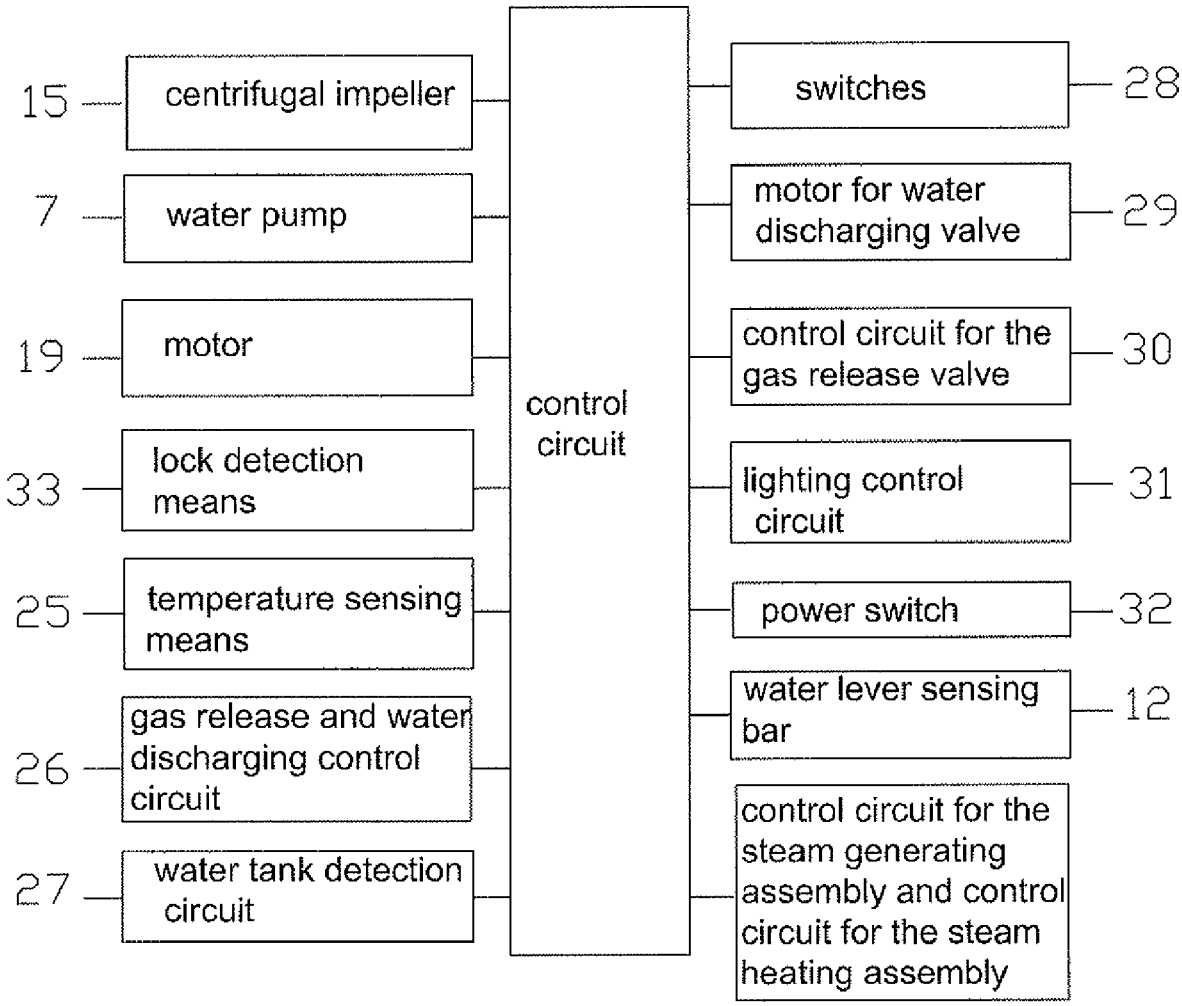
FIG. 4 is a schematic diagram of the control circuit of the multifunction microwave oven with superheated steam as shown in FIG. 1.

As shown in FIG. 4, the control circuit of the present invention includes a control unit 24 incorporating a microprocessor and a memory, by which the multifunction microwave oven works according to a preset program. Connected with the control unit 24 are the centrifugal impeller 15, the water pump 7, the motor 19, a lock detection means 33, a temperature sensing means 25, a gas release and water discharging control circuit 26, a water tank detection circuit 27, switches 28, a motor 29 for water discharging valve, a control circuit 30 for the gas release valve, a lighting control circuit 31, a power switch 32, the water level sensing bar 12, a control circuit for the steam generating assembly and a control circuit for the steam heating assembly.

Since the big boiler heating tube 10 and the small boiler heating tube 11 of the steam generating assembly can be controlled separately, and the upper big heating tube 16 and the upper small heating tube 17 of the steam heating assembly can be controlled separately, so that these four heating tubes can be controlled to work in different modes to generate at least superheated steam between 100° C. to 400° C., ordinary steam of approximately 100° C. and convective hot flow.

Under the control circuit, the superheated steam cooking mode is programmed as follows:

Step 1: after the oven is started, the water level sensing bar 12 detects whether water exists in the boiler 9, and sends the signal to the control unit 24;

Step 2: if no water is detected, the control unit 24 sends instructions to start the water pump 7, and the water pump 7 supplies prescribed amount of water to the boiler 9 via water pipes 8 within a preset time duration;

Step 3: After water enters the boiler 9, the big boiler heating tube 10 and a small boiler heating tube 11 are energized to heat the water to turn into ordinary steam of approximately 100° C.;

Step 4: the ordinary steam enters the convection heating cavity 14 through the ordinary steam pipe 13. Under the effect of the centrifugal impeller 15, ordinary steam from the boiler 9 and the gas coming from the cooking chamber 3 through the upper gas suction ports 23 are fed to be heated by the upper big heating tube 16 and the upper small heating tube 17. The gas is further heated up to 400° C. within the convection heating cavity 14.

Step 5: by the effect of the centrifugal impeller 15, the mixed gas with higher temperature enters the cooking chamber 3 through the upper gas outlets 22 and the lower gas outlets 24.

Wherein either the ordinary steam of about 100° generated by the steam generating assembly or the superheated steam between 100° and 400° generated by the steam heating assembly may have a pressure of 1 atm or above 1 atm (Standard atmosphere).

Thus, the ordinary steam from the boiler 9 and the gas from the cooking chamber 3 are heated and circulated by the effect of the centrifugal impeller 15, so as to increase the temperature of the gas within the cooking chamber 3 to approximately between 100° C. to 250° C.

Under the control circuit, the strong steam cooking mode is programmed as follows:

Step 1: after the oven is started, the water level sensing bar 12 detects whether water exists in the boiler 9, and sends the signal to the control unit 24;

Step 2: if no water is detected, the control unit 24 sends instructions to start the water pump 7, and the water pump 7 supplies prescribed amount of water to the boiler 9 via water pipes 8 within a preset time duration;

Step 3: After water enters the boiler 9, the big boiler heating tube 10 and a small boiler heating tube 11 are energized to heat the water to turn into ordinary steam of approximately 100° C.;

Step 4: the ordinary steam enters the convection heating cavity 14 through the ordinary steam pipe 13. Under the effect of the centrifugal impeller 15, ordinary steam from the boiler 9 and the gas coming from the cooking chamber 3 through the upper gas suction ports 23 are fed to be heated by one of the upper big heating tube 16 and the upper small heating tube 17, while the other one of the upper big heating tube 16 and the upper small heating tube 17 is not energized. The gas is further heated up to 200-300° C. within the convection heating cavity 14.

Step 5: by the effect of the centrifugal impeller 15, the mixed gas with higher temperature enters the cooking chamber 3 through the upper gas outlets 22 and the lower gas outlets 24.

Under the control circuit, the ordinary steam cooking mode is programmed as follows:

Step 1: after the oven is started, the water level sensing bar 12 detects whether water exists in the boiler 9, and sends the signal to the control unit 24;

Step 2: if no water is detected, the control unit 24 sends instructions to start the water pump 7, and the water pump 7 supplies prescribed amount of water to the boiler 9 via water pipes 8 within a preset time duration;

Step 3: After water enters the boiler 9, the big boiler heating tube 10 and a small boiler heating tube 11 are energized to heat the water to turn into ordinary steam of approximately 100° C.;

Step 4: the ordinary steam enters the convection heating cavity 14 through the ordinary steam pipe 13. Under the effect of the centrifugal impeller 15, ordinary steam from the boiler 9 and the gas coming from the cooking chamber 3 through the upper gas suction ports 23 are fed to the convection heating cavity 14. While neither of the upper big heating tube 16 and the upper small heating tube 17 is energized.

Step 5: by the effect of the centrifugal impeller 15, the mixed gas with higher temperature enters the cooking chamber 3 through the upper gas outlets 22 and the lower gas outlets 24.

Under the control circuit, the convective hot flow cooking mode is programmed as follows:

Step 1: after the oven is started, neither of the water level sensing bar 12 and the water pump 7 works.

Step 2: by the effect of the centrifugal impeller 15, the gas from the cooking chamber 3 enters the convection heating cavity 14; both of the upper big heating tube 16 and the upper small heating tube 17 are energized to heat the dry gas, and the hot gas flow enters the cooking chamber 3 through the upper gas outlets 22 and the lower gas outlets 24.

Since the superheated steam, ordinary steam and convective hot flow can enter the cooking chamber 3 through both of the upper gas outlets 22 and the lower gas outlets 24, the food loaded on the glass rotating disc 2 driven by the motor 1 will be cooked uniformly.

With the multifunction microwave oven of the present invention, one can cook food with a high speed, high quality and versatile modes. The water in the food is preserved during cooking, the food cooked is fresh and tender, with its original taste and color. And what is more important, the superfluous fat and salt in the food is removed, vitamins and minerals are preserved, the food cooked has low calorie and is more healthy.

The various cooking functions include baking, air convective baking, water baking, steaming, microwave cooking, thaw and zymolysis, etc. And the multifunction microwave oven of the present invention can be used to cook daily food such as meat, fowl, seafood, vegetable, cake and biscuit, etc.

According to the present invention, convective superheated steam can be generated when the oven has not been loaded with food so as to clean the dirt on the walls of the cooking chamber.

According to the present invention, after lemon scour is added to the water tank, the water tank operates when the oven has not been loaded with food so as to remove the scale inside by the recycling of the lemon water in the system.

What is claimed is:

1. A multifunction microwave oven with superheated steam, comprising a casing, a cooking chamber for accommodating food to be cooked, a microwave generating assembly for generating microwave for cooking food, a steam generating assembly, a steam heating assembly and a control circuit;

wherein the steam generating assembly for generating ordinary steam of approximately 100° C. is located at the bottom or beside of the casing; said steam generating assembly includes a water tank, a water pump, water pipes, a boiler and an ordinary steam pipe, and wherein the water tank is located at the bottom or beside of the cooking chamber, and the boiler incorporates a heating means and a water level sensing means;

wherein the steam heating assembly for generating superheated steam up to 400° C. is located at the top or beside of the cooking chamber; said steam heating assembly includes a convection heating cavity incorporating a centrifugal impeller and its driving means, and a heating means;

wherein the ordinary steam pipe is connected with the convection heating cavity, and the ordinary steam from the boiler enters the convection heating cavity through this ordinary steam pipe; upper gas outlets and upper gas suction ports are disposed at a bottom panel of the convection heating cavity; and wherein the upper gas suction ports include plurality of through holes distributed within an inner circular region at the bottom panel of the convection heating cavity, and the upper gas outlets include plurality of through holes distributed within an outer circular ring at the bottom panel of the convection heating cavity, so that the superheated steam passes through the upper gas outlets of the convection heating cavity and blows outwardly and downwardly into the cooking chamber, while the backflowing gas is sucked from the central area of the cooking chamber and enters the convection heating cavity through the upper gas suction ports.

2. A multifunction microwave oven with superheated steam according to claim 1, wherein the inner circular region, the outer circular ring and the centrifugal impeller are concentric.

3. A multifunction microwave oven with superheated steam according to claim 2, wherein the blades of the centrifugal impeller are substantially located within the separation between the inner circular region and the outer circular ring.

4. A multifunction microwave oven with superheated steam according to claim 1, the convection heating cavity has a side passage connected to the cooking chamber, and the interface between the convection heating cavity and the cooking chamber is a wall with plurality of through holes thereon, namely the lower gas outlets.

5. A multifunction microwave oven with superheated steam according to claim 4, wherein some of the superheated steam passes through the upper gas outlets of the convection heating cavity and blows outwardly and downwardly into the cooking chamber, while some of the superheated steam passes through the lower gas outlets and blows forwardly and horizontally to the lower region of the cooking chamber, and while the backflowing gas is sucked from the central area of the cooking chamber and enters the convection heating cavity through the upper gas suction ports.

6. A multifunction microwave oven with superheated steam according to claim 1, wherein the water level sensing means is a water lever sensing bar installed within the water tank, whose resistance value varies with the water level, so that a control unit of the control circuit will acquire the information of the water level and send instructions to the water pump.

7. A multifunction microwave oven with superheated steam according to claim 1, wherein the heating means of the boiler includes a first boiler heating tube and a second boiler heating tube which can be controlled separately.

8. A multifunction microwave oven with superheated steam according to claim 1, wherein the heating means of the convection heating cavity includes a first upper heating tube and a second upper heating tube which can be controlled separately.

9. A multifunction microwave oven with superheated steam according to claim 1, wherein the heating means either in the steam generating assembly or in the steam heating assembly may be chosen from the group of heating tubes, electric-heated diaphragms and semiconductor heating means or combination thereof.

10. A multifunction microwave oven with superheated steam according to claim 1, wherein the control circuit includes a control unit incorporating a microprocessor and a memory, by which the multifunction microwave oven works according to a preset program; and wherein connected with the control unit are the centrifugal impeller, the water pump, the motor for the centrifugal impeller, water level sensing bar, control circuit for the steam generating assembly and control circuit for the steam heating assembly.

11. A multifunction microwave oven with superheated steam according to claim 10, wherein the heating means of the boiler includes a first boiler heating tube and a second boiler heating tube which can be controlled separately; and wherein the heating means of the convection heating cavity includes a first upper heating tube and a second upper heating tube which can be controlled separately.

12. A multifunction microwave oven with superheated steam according to claim 11, wherein the convection heating cavity has a side passage connected to the cooking chamber, and the interface between the convection heating cavity and the cooking chamber is a wall with plurality of through holes thereon, namely the lower gas outlets.

* * * * *